US006279592B1

(12) United States Patent
Yamamoto

(10) Patent No.: US 6,279,592 B1
(45) Date of Patent: Aug. 28, 2001

(54) FLEXIBLY ELASTIC AND LIGHT REFLECTIVE TIP FOR STICKS

(75) Inventor: Yoshikazu Yamamoto, Hiratsuka (JP)

(73) Assignee: Kabushiki Kaisha Daiwa, Kanagawa-ken (JP)

( * ) Notice: Subject to any disclaimer, the term of this patent is extended or adjusted under 35 U.S.C. 154(b) by 0 days.

(21) Appl. No.: 09/557,761

(22) Filed: Apr. 25, 2000

(30) Foreign Application Priority Data

Apr. 28, 1999 (JP) ..... 11-122209
Mar. 6, 2000 (JP) ..... 12-60283

(51) Int. Cl.[7] ..... A45B 9/04
(52) U.S. Cl. ..... 135/77; 135/82; 135/86
(58) Field of Search ..... 135/77, 82, 86, 135/910; 248/188.9; 362/102; D3/7

(56) References Cited

U.S. PATENT DOCUMENTS 5,178,176 * 1/1993 Fetterman ..... 135/86
5,810,038 * 9/1998 Carpinella ..... 135/77

FOREIGN PATENT DOCUMENTS

659233 * 2/1929 (FR) ..... 135/77
58-139919 U 9/1983 (JP) .
6-26525 U 4/1994 (JP) .
11-6922 1/1999 (JP) .

* cited by examiner

*Primary Examiner*—Robert Canfield
(74) *Attorney, Agent, or Firm*—James Creighton Wray; Meera P. Narasimhan

(57) ABSTRACT

The object of the present invention is to provide a flexibly elastic and light reflective tip for stick use, which improves the safety in use of a stick. In the present invention, this object is attained by providing an irregular reflecting surface on the upper portion of the tip by forming a cylindrical metal having an excellent light reflectivity by plating or pressing, to have a cross-sectionally serrated or wave form for more reflectivity.

4 Claims, 6 Drawing Sheets

FLEXIBLY ELASTIC AND LIGHT REFLECTIVE TIP FOR STICKS

BACKGROUND OF THE INVENTION

1. Field of the Invention

The present invention relates to a flexibly elastic and reflective tip for various sorts of sticks such as a single-handed cane, a crutch, etc., and in more particular, for sticks targeted for night use by aged persons, by physically handicapped persons, patients and/or injured persons.

2. Brief Description of the Prior Art

Generally, various sorts of sticks with tips have been known so far, and most of those sticks are equipped respectively with elastic tips formed of rubber, etc., on the lowermost end of the stick.

In recent years, flexibly elastic tips employing a ball joint have also been known.

In case of the above-mentioned elastic tip, the tip can attain its initial purpose of preventing the stick from slipping if the stick is applied perpendicular to the ground. However, in ordinary walks, especially on slopes or steps, it is difficult to always keep the stick perpendicular to the ground, wherein the tip contacts slant against the ground and cannot assure the stable condition for its effective use. An elastic tip equipped with a V-shape annular concave groove (Laid-Open Utility Model No. 58-139919) and the one with a constricted groove (Laid-Open Utility Model No. 6-26525) are also known, which are neither responsive nor durable enough in case of a slant use of a stick.

On the other hand, although the latter tip can solve the problem and deficiency of the former tip, the ball joint constitution makes the tip structure complicated. Besides, the movable portion embracing the ball appears outside, being exposed as a a sliding part so that dust and sand on roads are liable to enter the inside through the discrepancy formed between the ball and the movable portion, resulting in mechanical troubles.

In order to solve these problems, the applicant of the present invention proposed a flexibly elastic tip for stick use with no movable portion nor sliding part, monolithically formed as a whole providing an annular concavity, and simply constituted, which is flexibly deformable, to have a good restoring function and the stick shod with the same, as a series of invention under the Patent Application No. 10-152928 and No. 11-6922. In addition to those two inventions, the applicant proposed a further improved type of a flexibly elastic tip for stick use and a stick shod with the same, under the Patent Application No. 11-94939, having no looseness of the connection of the tip and the lowermost end of the stick for assuring a firmly-fixed and stable junction, thereby attaining more comfortable use of the stick.

In Patent Application Nos. 11-6922 and 10-351500, the applicant also proposed a tip having a reflection plate on a part of the outside periphery of the tip, which glitteringly reflects headlights of automobile vehicles, street lights, etc. to show up the user, so that it can assure safe walking at night or in darkness.

In addition to said inventions formerly proposed and applied by the applicant, the present invention is aimed at providing a more decent-looking flexibly elastic and reflective tip for stick use, with a specular surface of a serrated or wave formed sectional view on the upper periphery of the tip itself to improve the reflectivity, and at making the reflective member cylindrical and compact directly or by pressing for the purpose of easy forming and affixing. Further, the tip itself can be comprised mainly of hard elastic rubber or hard elastic synthetic resin so as to be easily and assuredly fixed with the lowermost end of the stick pipe.

SUMMARY OF THE INVENTION

This invention is a flexibly elastic tip for stick use, constituted of the lower portion for contacting the ground, an upper portion on which a stick inserting hole to insert a stick into is opened and a flexibly deformable portion for connecting said two portions. The whole tip is fabricated of an elastic material, and on the upper periphery of said upper portion a cross-sectionally serrated or wave formed surface is formed whereto a reflective material is affixed to provide an irregular reflective surface, so that the headlights of automobile vehicles, street lights, etc are reflected and emitted glitteringly at night in multi-directions from the irregular reflecting surface of the tip, which attracts the attention not only of pedestrians but also of car drivers, thereby assuring the stick user's safe walking at night.

DETAILED DESCRIPTION OF THE PREFERRED EMBODIMENTS

Hereinafter is detailed an embodiment according to the present invention with reference to the drawings of FIG. 1 to FIG.8.

Figure 1:
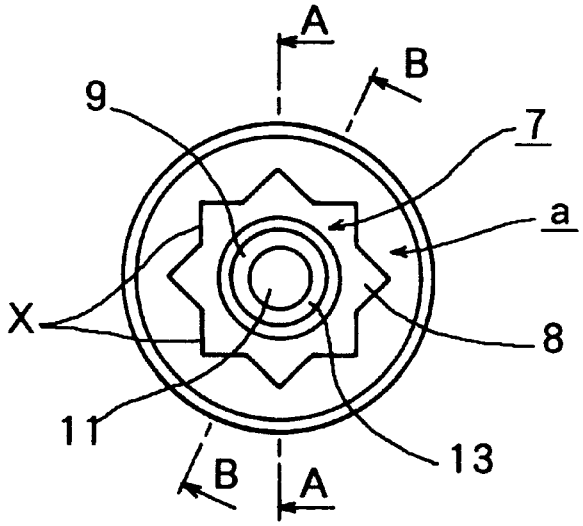
FIG. 1 is a plan view showing an embodiment of a flexibly elastic and reflective tip for stick use relating to the present invention.
Figure 2:
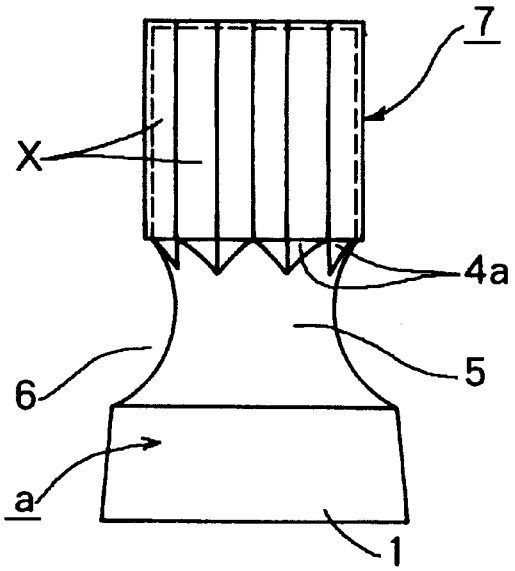
FIG.2 is the side view of FIG. 1.
Figure 3:
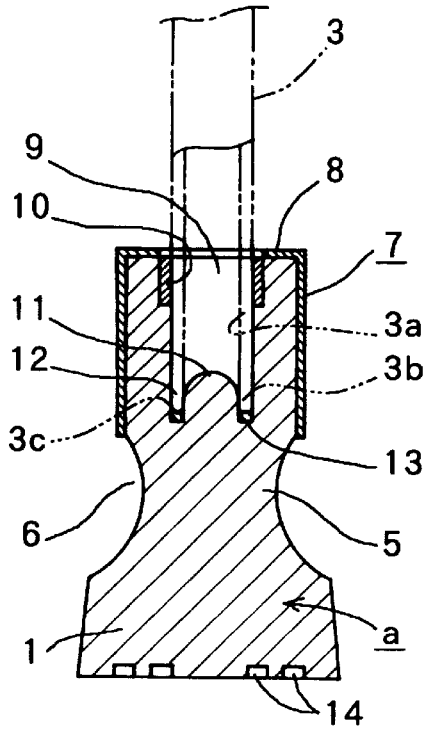
FIG.3 is the cross-sectioned view of FIG. 1 cut along the line A—A of FIG. 1.
Figure 4:
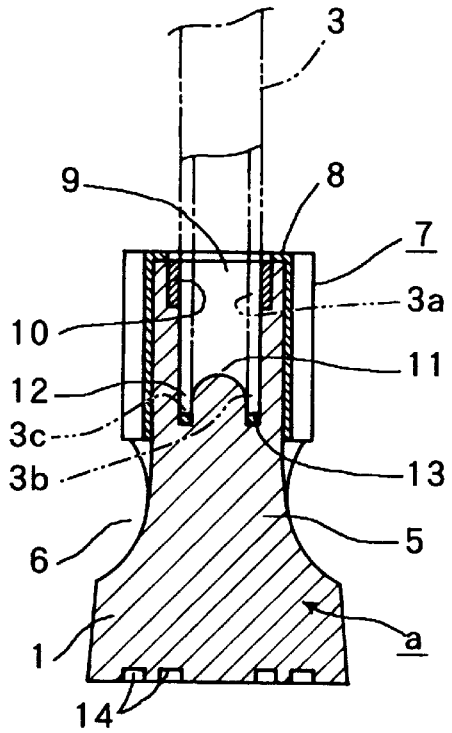
FIG. 4 is the cross-sectioned view of FIG. 1, cut along the line B—B of FIG. 1.
Figure 5:
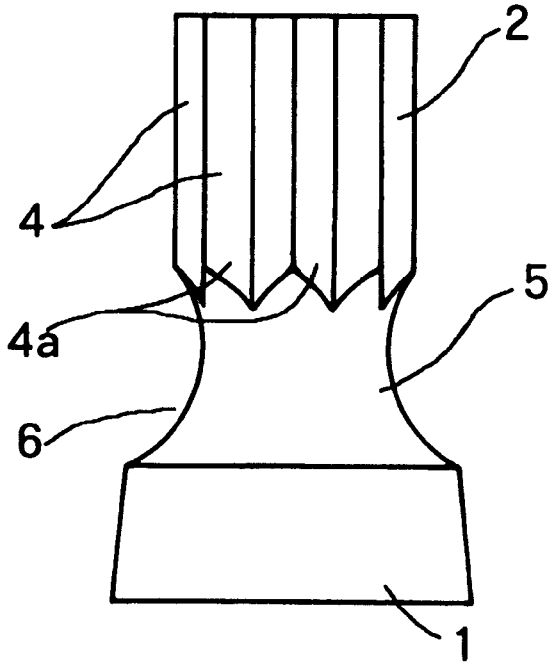
FIG.5 is the side view of the tip removed of the metal reflector.
Figure 6:
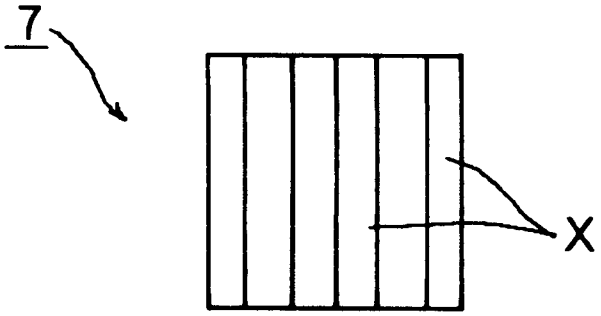
FIG.6 is the side view of the metal reflector.
Figure 7:
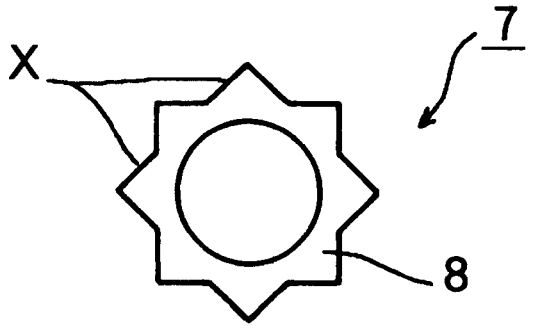
FIG.7 is the plan view of the metal reflector.
Figure 8:
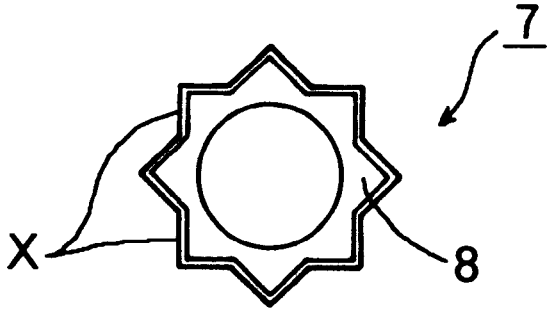
FIG.8 is the bottom view of the metal reflector.

In each figure, the numeric sign 1 stands for the lower portion of the truncated cone for contacting the ground, 2 stands for a column-shaped upper portion of the tip fixed to the lower end 3*a* of a pipe-type or bar-type stick 3, having the diameter which is the same as or shorter than that of the upper end diameter of said lower portion 1, and forming the cross-sectionally serrated or wave formed peripheral surface 4 in FIG. 5. The numeric sign 5 is the flexibly deformable portion connecting the above-mentioned portions 1 and 2, provided between those two portions, forming an annular concavity 6 as illustrated in the longitudinal section view, with its top chord reaching the bottom chord of the upper portion 2, thereby forming the cross-sectioned pattern 4*a* on the serrated or wave formed surface 4. The lower portion 1, the flexibly deformable portion 5 and the upper portion 2 are integrally formed to constitute the tip itself, which is divisionally or monolithically fabricated of hard elastic rubber or hard elastic synthetic resin, and the hard elastic rubber or hard elastic synthetic resin material may be colored in black, brown, yellow or in any other desired color. The numerical sign 7 shows a tubular metal reflector, cylindrically constituted, having a collar 8 with the same reflecting surface as above mentioned, engaged with the upper peripheral surface of said upper portion 2, on the upper end of the serrated or wave formed specular surface X which is fixed by engagement with the irregular peripheral surface 4 of the upper portion 2.

And this metal reflector 7 can be formed by pressing of a plate of thin metal, such as steel, aluminum, stainless steel, etc., and the irregular reflecting surface is preferably finished by mirror grinding of the irregular reflecting surface X through plating or the like. This metal reflector 7 may be constituted so as to be removable.

Although said irregular reflecting surface X may be a metal reflector 7 which is totally colored as desired, white silver is generally preferable. However, any other color such as red, yellow, etc. that attracts an attention or cautions a danger may also be used; or, instead of plating, finish by reflective painting or by pasting a sheet material with a strong adhesive may be adopted.

The numerical sign 9 is the stick inserting hole opened in the center of the top surface of the upper portion 2, a metal annulus 10 is monolithically embedded in molding, along the inside wall of the opening, to ensure the shaping of the hole and supporting of the inserted stick.

11 is a columnar projection provided in the center of the bottom surface of the stick-inserting hole 9, forming an annular groove 12 between the projection and the inside wall of 9 to firmly fix and support the lower end brim 3*b* of the stick 3, and employing a washer 13 on the bottom end of the annular groove 12 to be firmly stuck to the lowermost end of the stick 3*c*.

14 stands for the concentric circular grooves to prevent slipping, provided on the bottom surface of the lower portion 1 of the tip.

On the basis of the above-mentioned constitution, hereunder is described on how it works.

If the stick 3 is used by inserting its lower end to the tip through the stick inserting hole 9 opened on the upper portion 2, mainly the longitudinal-sectionally arc form annular concavity 6 of the portion 5 flexibly deforms according to the changes in the ground-contacting angle of the stick 3, thereby keeping the lower portion 1 perpendicular with respect to the ground surface to prevent slipping, which helps the user enjoy safe walking.

Further, in the darkness i.e. at night, etc., headlights from automobile vehicles or street lights, etc. scattered on the serrated or wave formed surface of the metal reflector 7 installed on the upper portion 2, are glitteringly scattered around and attract the attention not only of car drivers but also pedestrians, which can prevent unexpected accidents. Particularly, the irregular reflective surface X can change the reflecting direction according to the movements of the tip a, thereby attracting more attention of other people.

Another point is that the tip itself a can be molded of hard elastic rubber or hard elastic synthetic resin of a desired color, which makes the stick more fashionable and comfortable to use.

The metal reflector 7 having an irregular reflection surface X can be manufactured by pressing of a desired thin metal plate as a cylinder with a collar, and the inside wall of the irregular reflecting surface X is engaged with the irregular peripheral surface 4 of the upper portion 2 and the guard 8 is interlocked with the peripheral surface of the upper portion 2, making the fixing very easy. Moreover, the metal reflector 7 may be small enough to be employed without any incompatibility and with a good balance.

For fitting the stick 3 to the tip a, the bottom brim 3*b* of the lower end 3*a* is inserted into the annular groove 12 to be assuredly and firmly held by the inside wall of the lower portion of the stick inserting hole 9 and the projection 11, while the lower end 3*c* is positioned by its firm joining with the washer 13 at the bottom portion, and the lower end 3*a* is held by the annulus 10 embedded on the inside wall of the opening of the stick inserting hole 9, to prevent coming off of the stick as well as assuredly to maintain the shape of the stick inserting hole 9, resulting in total strengthening of the tip itself.

Figure 9:
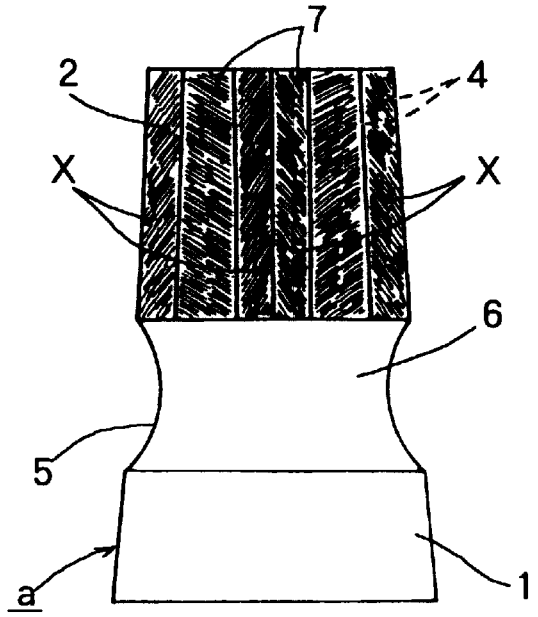
FIG.9 is the side view of another embodiment of a flexibly elastic and reflective tip according to the present invention.
Figure 10:
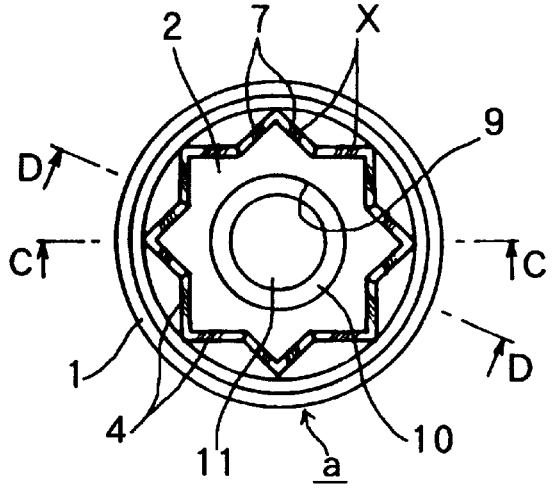
FIG. 10 is the top face plan of FIG.9.
Figure 12:
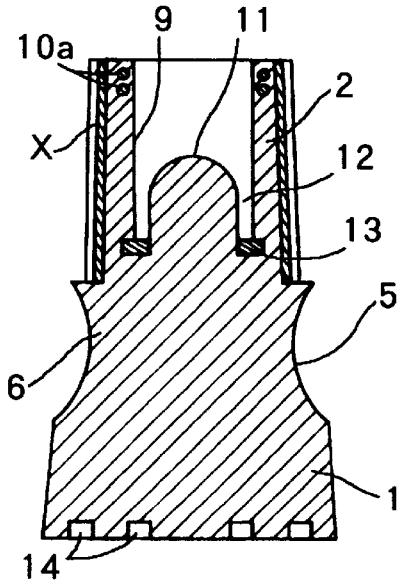
FIG.12 is the cross-sectioned view of FIG.10, cut along the line D—D.

The following is the description of another embodiment of the present invention, according to FIG.9 and FIG. 12.

For practically the same constituents as those of the aforesaid embodiment, the same signs are used to save their detailed description.

In this embodiment, the irregular reflecting surface X on the irregular peripheral surface 4 formed on the periphery of the upper portion 2 is fabricated of a plated reflective material, which, in the figures attached hereto, is shown as a serrated surface 7 of a regular octagonal shape. Or it can also be formed as an irregular surface with higher waves and the number of the curvatures may either be larger or smaller; and the uneven surface may either be projected out of the upper portion 1 or be drawn inward, though the illustration shows the "drawn inward" case.

For the aforesaid irregular reflecting surface X, although a reflective material painted in any favorite color may be used, more cautionary or attention-attracting colors such as red, yellow, etc. are generally preferred, or, instead of plating, reflective painting finish is applicable or a sheet material may be pasted with a strong adhesive In this embodiment, a coiled holder 10*a* of metal wire with strong hardness such as iron wire, or metal wire with high elasticity and restorability such as steel wire or piano wire, is embedded in the inner wall of the stick inserting hole 9 of the upper portion 2, in the form of double-coiled line as illustrated, which can prevent unnecessary extension of the opening and to assuredly strengthen the holding by eliminating the loosening of the contact with the periphery of the fixing portion 3*a* of the lower end of the stick 3.

A coil spring or a tire cord with necessary elasticity may be contained inside the annular concavity 5 below said stick inserting hole 9.

Figure 11:
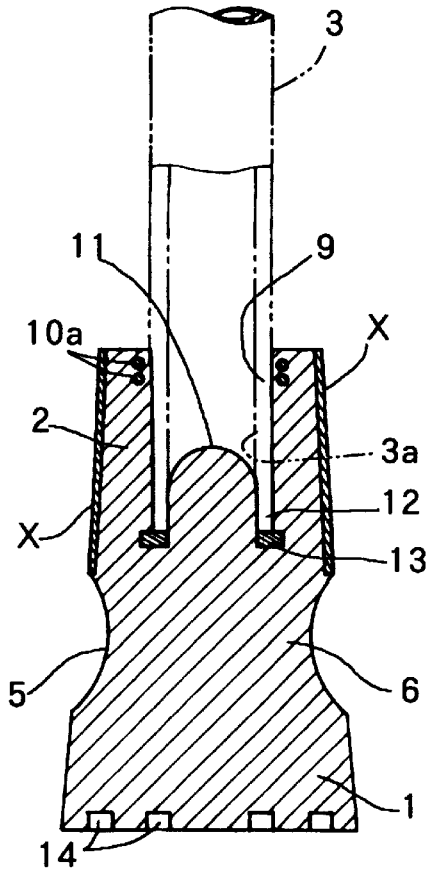
FIG.11 is the cross-sectioned view of FIG.10, cut along the line C—C, with the chain line showing the fixing status of the stick pipe end to the tip.

With the above-mentioned constitution of the tip, the lower pipe-form end 3*a* of a favorite stick 3 to be fitted to the tip is inserted into the stick inserting hole 9 of the upper portion 2 of the tip as shown in FIG. 11.

The inner wall of the tip fitting end 3*a* is closely inserted along the periphery of the projection 11, and the outer wall of 3*a* along the inner wall of the stick inserting hole 9, to be perfectly and elastically held in the circular groove 12, while the tip fitting end 3*a* is stopped and fixed firmly by being pressed against the washer 13.

Therefore, the tip fitting end 3*a* can be easily fixed to the tip only by inserting action. Otherwise, to ensure better adhesion to the stick inserting hole 9, an adhesive agent may be used as an aid.

In using the tip for a stick, the flexibly deformable portion 5 deforms pliably though the stick itself is liable to be used slant, enabling the whole area of the bottom of the lower portion 1 to always contact the ground surface to prevent unexpected slipping so that the stick can perfectly attain its purpose.

Additionally, in darkness or at night, lights from automobile vehicles, streets, shops, etc. are reflected on the uneven reflective surface X installed on the periphery of the upper portion 2 to be glitteringly scattered around, so that unexpected accidents are prevented as the stick user can be noticed from a wide area, thereby assuring the user's safety.

Moreover, the whole tip is monolithically molded, which results in low cost for the tip as well as the easy fabrication of the irregular reflective surface X.

According to this invention, the tip itself can be manufactured by monolithical molding of hard elastic rubber or hard elastic synthetic resin, and the flexibly deformable portion of the annular concavity with a longitudinal-sectionally arc form curves and deforms, thereby preventing slipping and assuring the safe use of the stick, and the metal reflector attached onto the upper portion can emit the reflected light glitteringly at night or in the darkness so that the stick user can be noticed. More than that, due to the irregularity of the reflective surface, the reflected light turns to variable scattered light, which helps the stick user become more noticeable.

Further, according to the present invention, on the periphery of the upper portion, a cross-sectionally serrated or wave formed surface is formed, and an irregular reflecting surface is fabricated of a reflective material on said irregular surface of the tip, which can effectively scatter the lights from cars, street lights, etc. in a square direction, enabling the user walk in safe in darkness or at night. Besides, for connection of the tip with the pipe-form stick itself, firm fixing is attainable by engagement of the inner wall and the outer periphery of the pipe-form end of the stick with the circular groove formed between the projection and the stick inserting hole, and the user can enjoy safe and long-time use in the status where the uneven bottom surface of the tip is perfectly contacted to the ground Another feature of the present invention is that the whole tip may be integrally molded and the irregular reflective surface can be easily manufactured either by plating, by coating a reflective material, or by pressing of a metal plate, resulting in low costs and mass production.

What is claimed is:

1. A flexibly elastic and light reflective tip for stick use, comprising:

a truncated cone formed lower portion for contacting the ground;

an upper portion for fitting a stick, having a cross-sectionally serrated or wave formed circumferential surface;

a flexibly deformable portion constituted of an annular concavity of a longitudinal-sectionally arc form, connecting said both portions;

wherein: a cylindrical reflective metal having a collar to be engaged with the peripheral surface of said upper portion, caps and fits on said upper portion of the serrated or wave formed surface for reflection fixed to aforesaid irregular peripheral surface of the upper portion; and said tip itself is fabricated of hard elastic rubber or hard elastic synthetic resin.

2. A flexibly elastic and light reflective tip for stick use according to claim 1, wherein: an annulus is embedded on the inside wall of a stick inserting hole for keeping the hole shape and supporting the stick;

a columnar projection is provided in the center of the bottom surface of said hole of the upper portion to form an circular groove between said projection and the inside wall of the lower portion of said hole; and a washer is embedded on the bottom of this annular groove.

3. A flexibly elastic and light reflective tip for stick use, fabricated of an elastic material of a truncated cone shape as a whole, comprising:

a lower portion for contacting the ground;

an upper portion for fitting the stick, where a stick inserting hole is opened;

a flexibly deformable portion formed of a longitudinal-sectionally arc form annular concavity connecting said two portions;

a serrated or wave formed surface formed on the periphery of said upper portion; and a reflective material installed to form an irregular reflecting surface.

4. A flexibly elastic and light reflective tip for stick use, fabricated of an elastic material as a whole, comprising:

a lower portion for contacting the ground;

an upper portion for fitting the stick, where a stick inserting hole is opened; and an flexibly deformable portion connecting said two portions, a columnar projection provided in the center of the bottom surface of the stick inserting hole of said upper portion to form a circular groove between said projection and the inside wall of said stick inserting hole, and a washer is embedded at the bottom portion of said circular groove.

* * * * *